US011017657B1

(12) United States Patent
Adetoye

(10) Patent No.: US 11,017,657 B1
(45) Date of Patent: May 25, 2021

(54) NETWORK ENABLED FIRE SENSOR AND EXTINGUISHING SYSTEM

(71) Applicant: Olayinka Adetoye, Laurel, MD (US)

(72) Inventor: Olayinka Adetoye, Laurel, MD (US)

( * ) Notice: Subject to any disclaimer, the term of this patent is extended or adjusted under 35 U.S.C. 154(b) by 0 days.

(21) Appl. No.: 16/799,943

(22) Filed: Feb. 25, 2020

(51) Int. Cl.

| | |
|---|---|
| ***G08B 1/00*** | (2006.01) |
| ***G08B 25/00*** | (2006.01) |
| ***A62C 3/02*** | (2006.01) |
| ***A62C 35/11*** | (2006.01) |
| ***A62C 35/02*** | (2006.01) |

(52) U.S. Cl.
CPC ..... *G08B 25/009* (2013.01); *A62C 3/0271* (2013.01); *A62C 3/0292* (2013.01); *A62C 35/026* (2013.01); *A62C 35/11* (2013.01); *G08B 25/003* (2013.01)

(58) Field of Classification Search
CPC .... G08B 25/009; G08B 25/003; G08B 17/06; G08B 17/10; G08B 1/00; A62C 3/0271; A62C 3/0292; A62C 35/026; A62C 35/11; G06K 1/00
USPC ..... 340/286.05, 531, 539.26, 577, 581, 584, 340/628, 629, 630
See application file for complete search history.

(56) References Cited

U.S. PATENT DOCUMENTS

| | | | | |
|---|---|---|---|---|
| 4,821,805 | A | 4/1989 | Saito | |
| D307,647 | S | 5/1990 | Yamamura | |
| 5,727,634 | A | 3/1998 | Ishida | |
| 5,808,541 | A * | 9/1998 | Golden | A62C 37/40 169/26 |
| 9,619,996 | B1 | 4/2017 | Smith | |
| 9,928,709 | B2 | 3/2018 | Takasu | |
| 9,990,824 | B2 * | 6/2018 | Rao | B05B 12/082 |
| 10,360,780 | B2 | 7/2019 | Balaji et al. | |
| 2007/0035404 | A1 * | 2/2007 | Levine | G08B 7/06 340/577 |
| 2013/0321149 | A1 | 12/2013 | Ben-Shuel | |
| 2018/0374330 | A1 * | 12/2018 | Balaji | G08B 25/14 |

FOREIGN PATENT DOCUMENTS

| | | |
|---|---|---|
| WO | 2012107927 | 8/2012 |

* cited by examiner

*Primary Examiner* — Shirley Lu

(57) ABSTRACT

The network enabled fire sensor and fire extinguishing system is a fire-fighting apparatus comprising a plurality of extinguisher modules. The plurality of extinguisher modules forms a wireless communication link between: a) the plurality of extinguisher modules, and, b) with an appropriate authority. When triggered by fire, the individual extinguisher module: c) releases a fire extinguishing chemical; and, d) transmits an alert message to both the appropriate authority and to the individual extinguisher modules remaining in the plurality of extinguisher modules containing the GPS coordinates of the transmitting individual extinguisher module. Each selected individual extinguisher module compares the GPS coordinates of the selected individual extinguisher mode to the GPS coordinates of the module alert message. If the span of the distance between the two coordinates is less than a previously determined span of distance, than the selected individual extinguisher module releases a fire retardant chemical.

16 Claims, 6 Drawing Sheets

NETWORK ENABLED FIRE SENSOR AND EXTINGUISHING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of human necessities including fire-fighting equipment, more specifically, the control of fire-fighting equipment by an actuating signal being generated by a sensor separate from an outlet device by both sensor and actuator. (A62C37/40)

SUMMARY OF INVENTION

The network enabled fire sensor and fire extinguishing system is a fire-fighting apparatus. The network enabled fire sensor and fire extinguishing system is configured for use in fighting a fire. The network enabled fire sensor and fire extinguishing system comprises a plurality of extinguisher modules, a commercially provided and publicly available cellular wireless network, and an appropriate authority. The commercially provided and publicly available cellular wireless network forms a wireless communication link between a first individual extinguisher module selected from the plurality of extinguisher modules and each of the individual extinguisher modules remaining in the plurality of extinguisher modules. The commercially provided and publicly available cellular wireless network further forms a wireless communication link between each individual extinguisher module contained in the plurality of extinguisher modules and the appropriate authority.

When any selected individual extinguisher module is exposed to a fire, the individual extinguisher module: a) releases a fire extinguishing chemical into the space surrounding the individual extinguisher module; b) transmits a module alert message to each of the individual extinguisher modules remaining in the plurality of extinguisher modules containing the GPS coordinates of the selected individual extinguisher module; c) captures an image of the space surrounding the selected individual extinguisher module; and, d) transmits an authority alert message to the appropriate authority containing both the GPS location of the selected individual extinguisher module and the image of the space surrounding the selected individual extinguisher module.

When any individual extinguisher module selected from the plurality of extinguisher modules receives a module alert message, the selected individual extinguisher module compares the GPS coordinates of the selected individual extinguisher mode to the GPS coordinates of the transmitted module alert message. If the span of the distance between the two coordinates is less than a previously determined span of distance, than the selected individual extinguisher module releases a fire retardant chemical.

This disclosure claims that the network enabled fire sensor and fire extinguishing system is intended for use in the general purpose of fire-fighting. However, the specification and claims of this disclosure will hereinafter implicitly assume that the network enabled fire sensor and fire extinguishing system is used for fighting an outdoor fire. This assumption is made for the purposes of simplicity and for clarity of exposition of the disclosure is not intended to limit the scope of the appended claims. Those skilled in the electrical and fire-fighting arts will recognize that the innovations described in this disclosure can be readily modified to accommodate the fighting of indoor fires with a minimum of modification and experimentation.

These together with additional objects, features and advantages of the network enabled fire sensor and fire extinguishing system will be readily apparent to those of ordinary skill in the art upon reading the following detailed description of the presently preferred, but nonetheless illustrative, embodiments when taken in conjunction with the accompanying drawings.

In this respect, before explaining the current embodiments of the network enabled fire sensor and fire extinguishing system in detail, it is to be understood that the network enabled fire sensor and fire extinguishing system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the network enabled fire sensor and fire extinguishing system.

It is therefore important that the claims be regarded as including such equivalent construction insofar as they do not depart from the spirit and scope of the network enabled fire sensor and fire extinguishing system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
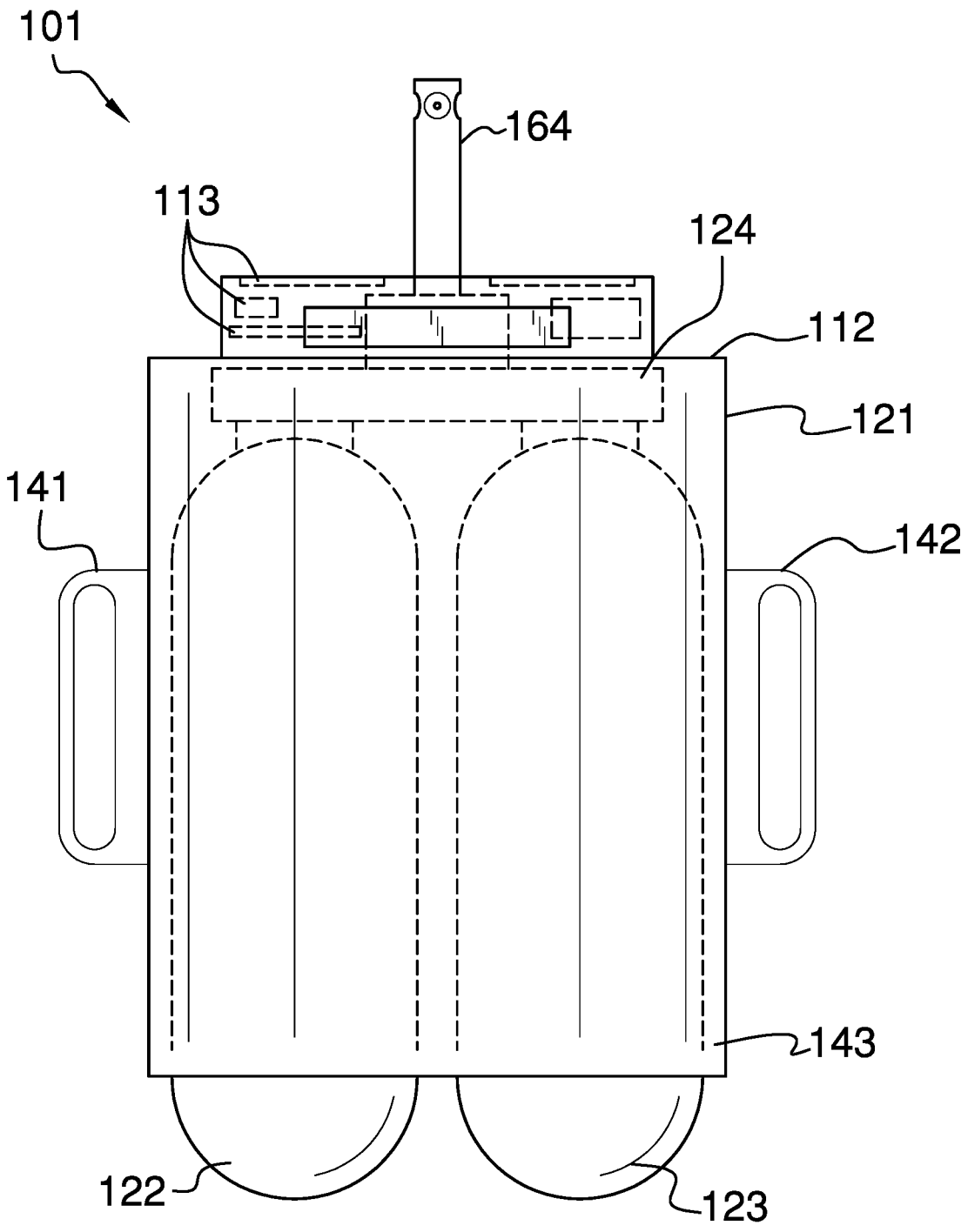
FIG. 1 is a front view of an embodiment of the disclosure.
Figure 2:
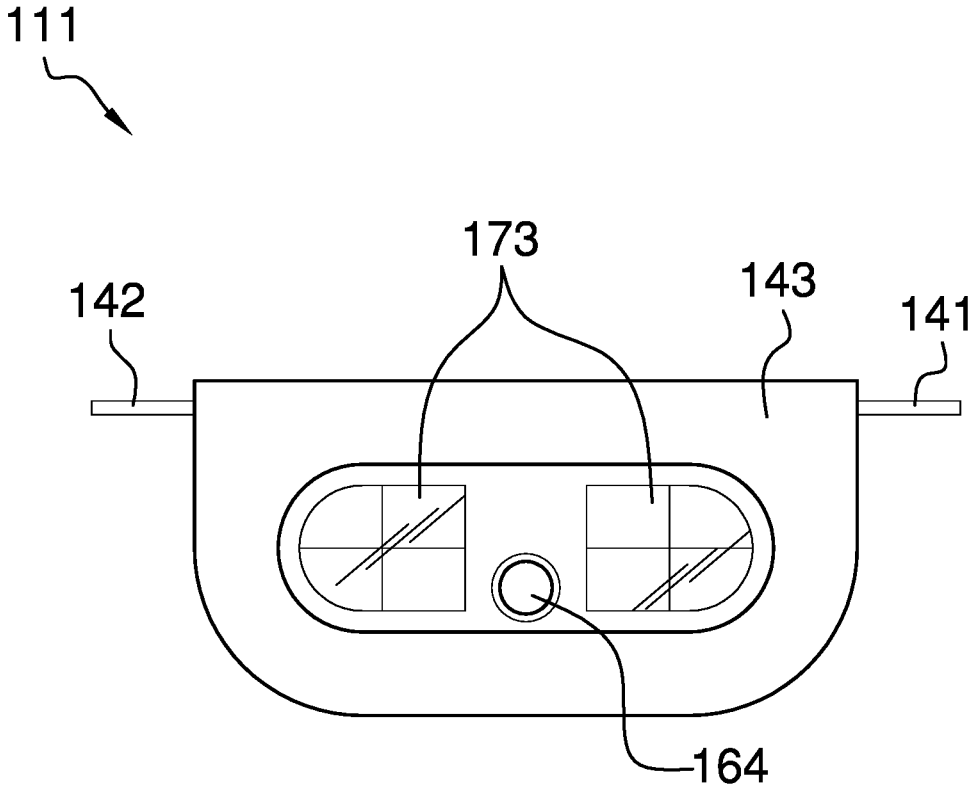
FIG. 2 is a side view of an embodiment of the disclosure.
Figure 3:
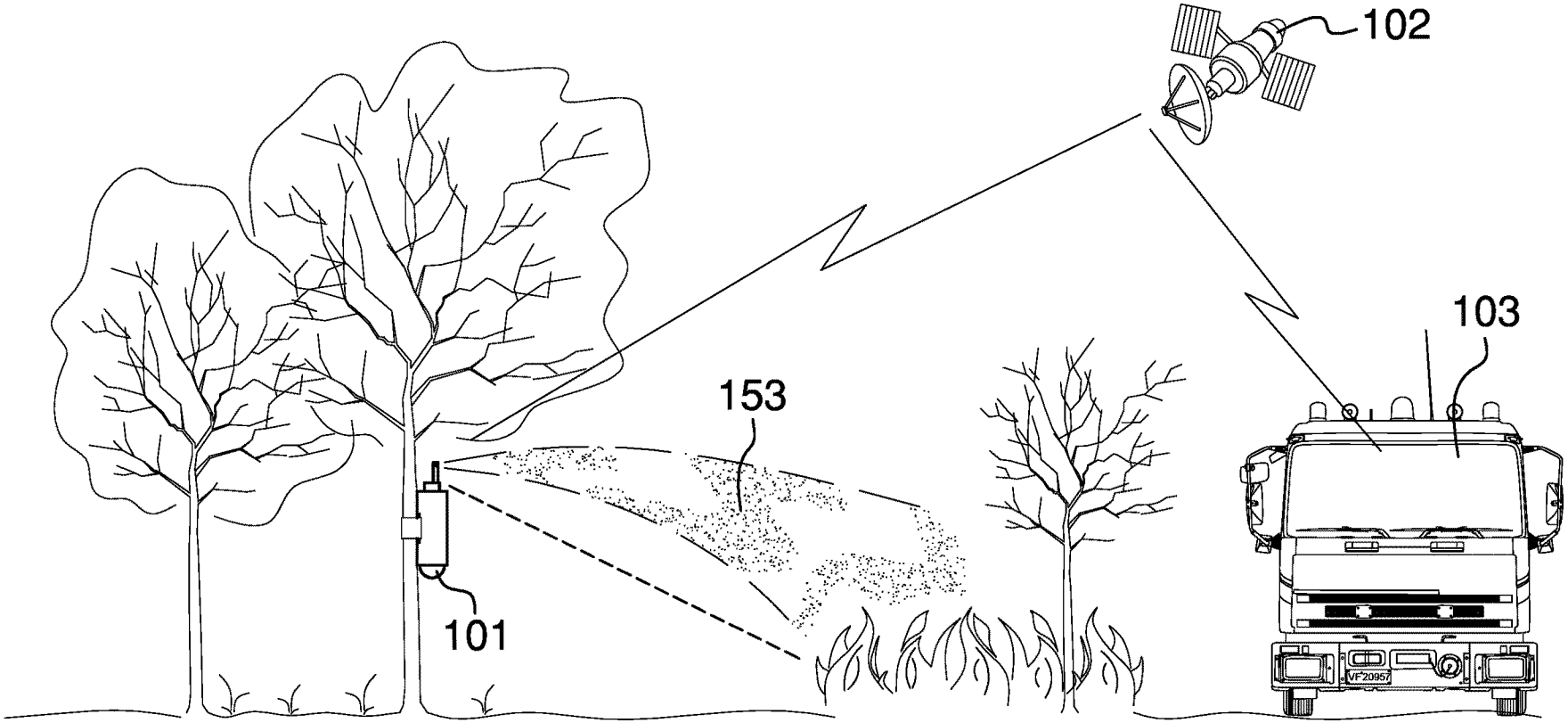
FIG. 3 is a top view of an embodiment of the disclosure.
Figure 4:
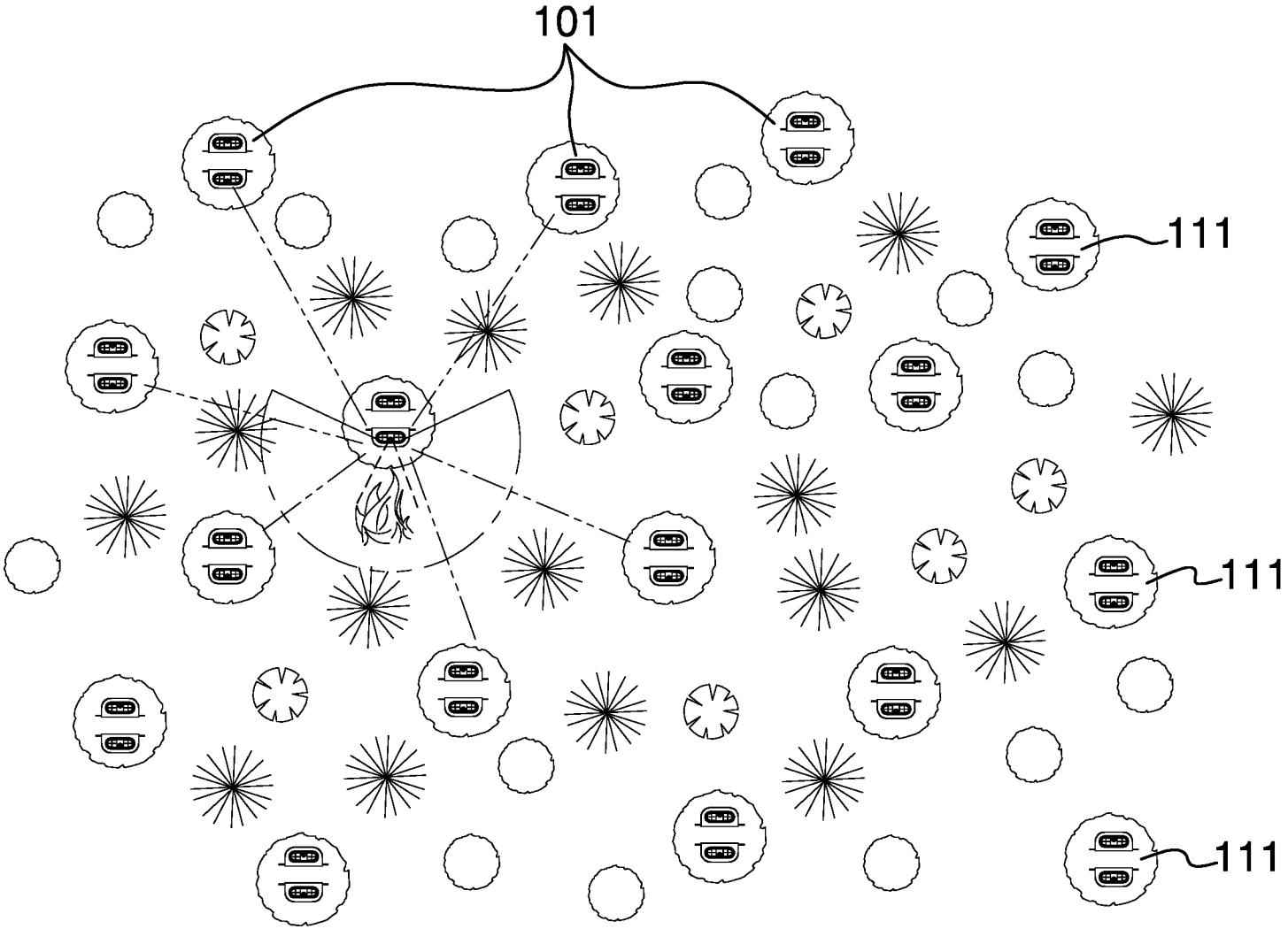
FIG. 4 is an in-use view of an embodiment of the disclosure.
Figure 5:
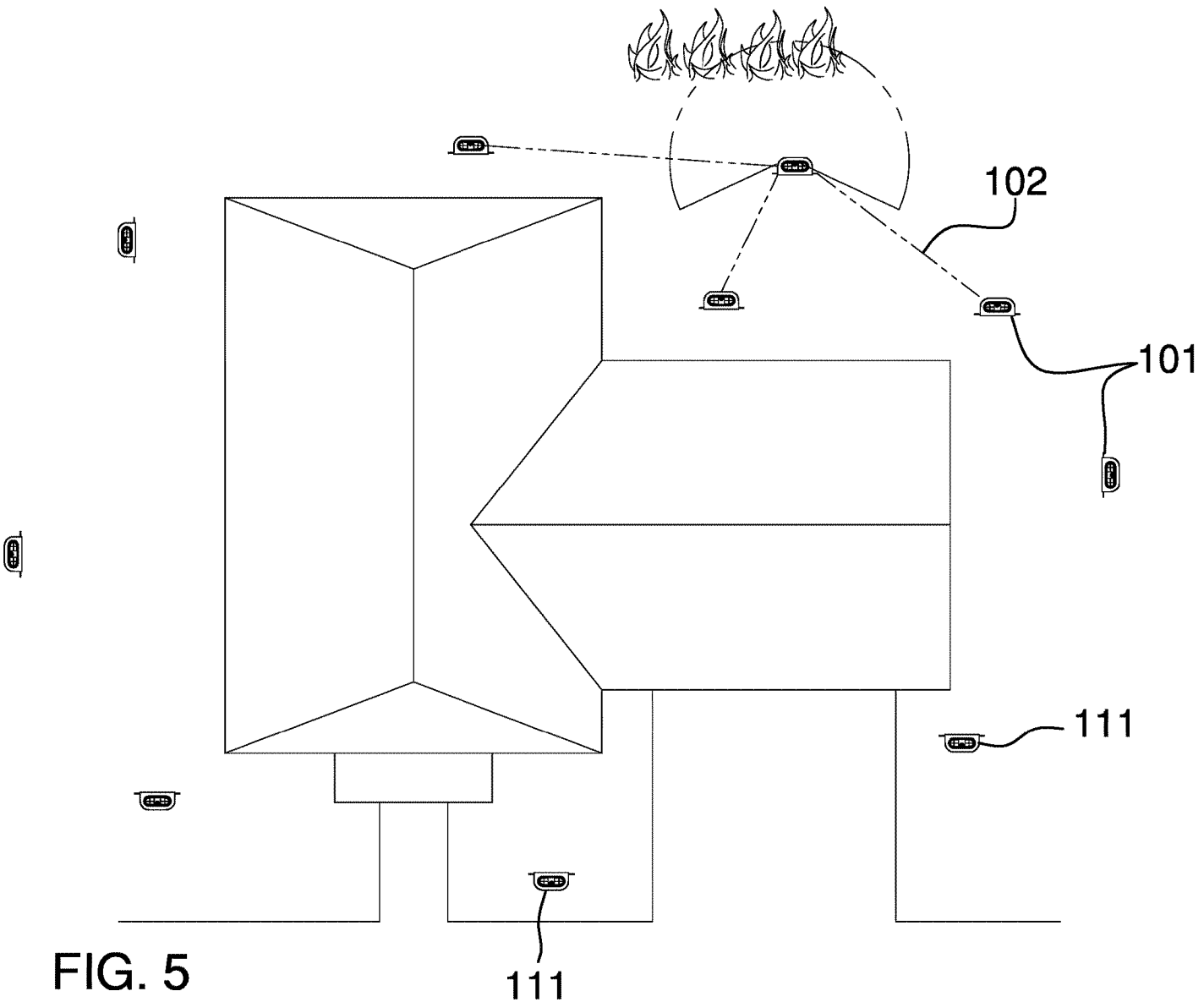
FIG. 5 is an in-use view of an embodiment of the disclosure.
Figure 6:
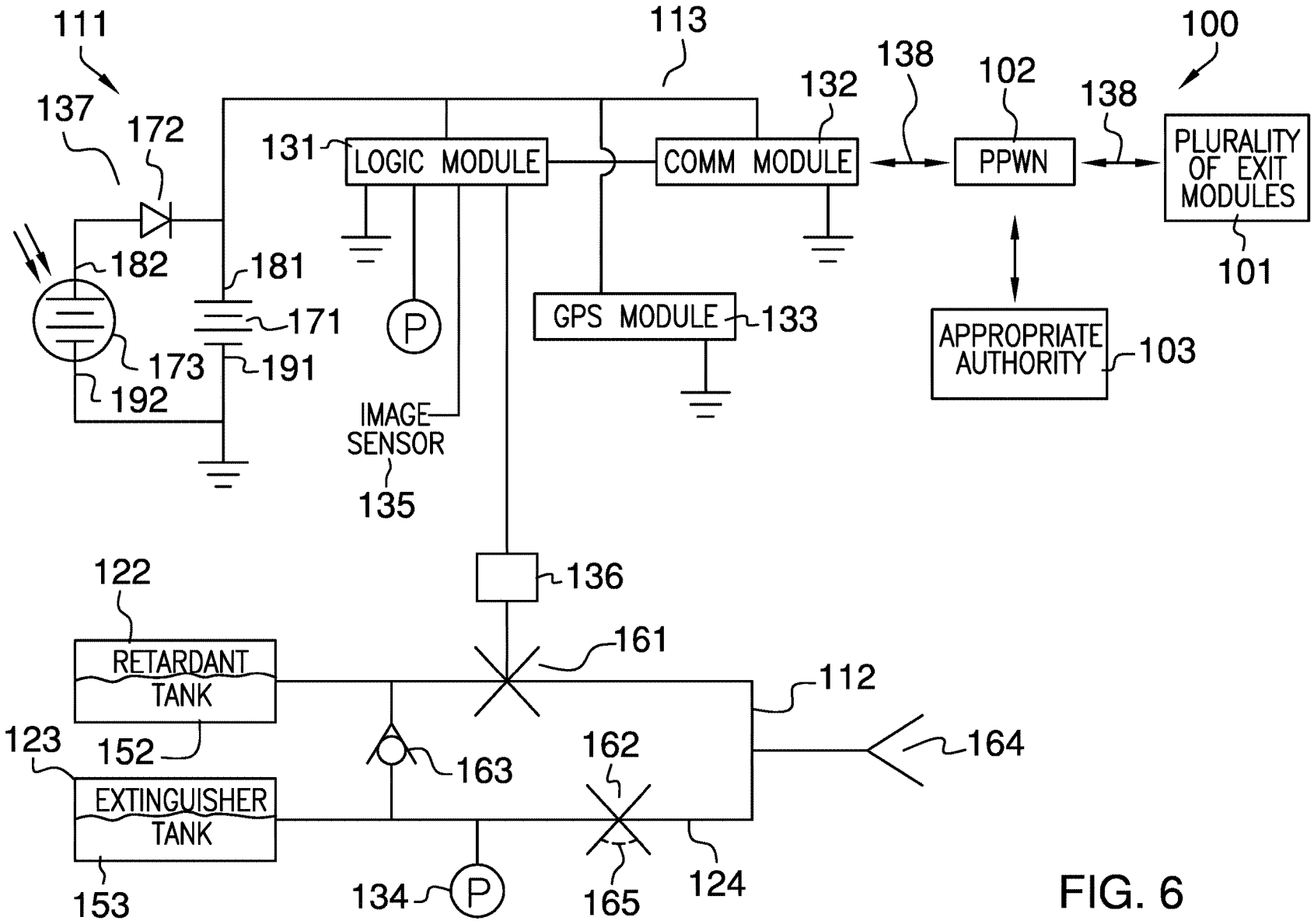
FIG. 6 is a schematic view of an embodiment of the disclosure.

Detailed reference will now be made to one or more potential embodiments of the disclosure, which are illustrated in FIGS. 1 through 6.

The network enabled fire sensor and fire extinguishing system 100 (hereinafter invention) is a fire-fighting apparatus. The invention 100 is configured for use in fighting a fire. The invention 100 comprises a plurality of extinguisher modules 101, a commercially provided and publicly available cellular wireless network 102, and an appropriate authority 103. The commercially provided and publicly available cellular wireless network 102 forms a wireless communication link 138 between a first individual extinguisher module 111 selected from the plurality of extinguisher modules 101 and each of the individual extinguisher modules 111 remaining in the plurality of extinguisher modules 101. The commercially provided and publicly available cellular wireless network 102 further forms a wireless communication link 138 between each individual extinguisher module 111 contained in the plurality of extinguisher modules 101 and the appropriate authority 103.

When any selected individual extinguisher module 111 is exposed to a fire, the individual extinguisher module 111: a) releases a fire extinguishing chemical 153 into the space surrounding the individual extinguisher module 111; b) transmits a module alert message to each of the individual extinguisher modules 111 remaining in the plurality of extinguisher modules 101 containing the GPS coordinates of the selected individual extinguisher module 111; c) captures an image of the space surrounding the selected individual extinguisher module 111; and, d) transmits an authority alert message to the appropriate authority 103 containing both the GPS location of the selected individual extinguisher module 111 and the image of the space surrounding the selected individual extinguisher module 111.

When any individual extinguisher module 111 selected from the plurality of extinguisher modules 101 receives a module alert message, the selected individual extinguisher module 111 compares the GPS coordinates of the selected individual extinguisher module 111 to the GPS coordinates of the transmitted module alert message. If the span of the distance between the two coordinates is less than a previously determined span of distance, than the selected individual extinguisher module 111 releases a fire retardant chemical 152.

This disclosure claims that the invention 100 is intended for use in general purpose of fire-fighting. However, the specification and claims of this disclosure will hereinafter implicitly assume that the invention 100 is used for fighting an outdoor fire. This assumption is made for the purposes of simplicity and for clarity of exposition of the disclosure is not intended to limit the scope of the appended claims. Those skilled in the electrical and fire-fighting arts will recognize that the innovations described in this disclosure can be readily modified to accommodate the fighting of indoor fires with a minimum of modification and experimentation.

The commercially provided and publicly available cellular wireless network 102 is described and defined elsewhere in this disclosure. The SMS message is defined elsewhere in this disclosure. The MMS message is defined elsewhere in this disclosure.

The appropriate authority 103 is an organization that is designated to respond to fire related incidents. The appropriate authority 103 is designated to receive and respond to the authority alert message generated by any individual extinguisher module 111 selected from the plurality of extinguisher modules 101. The response procedures of the appropriate authority 103 to the receipt of an authority alert message are determined by the appropriate authority 103 and are beyond the scope of this disclosure.

The plurality of extinguisher modules 101 forms a distributed structure. By distributed is meant that the plurality of extinguisher modules 101 are positioned over a region of space such that each individual extinguisher module 111 protects a sub-region of space within the region of space from fire. Each of the plurality of extinguisher modules 101 discharges a fire retardant chemical 152 over its sub-region of space. Each of the plurality of extinguisher modules 101 discharges a fire extinguishing chemical 153 over its sub-region of space. The plurality of extinguisher modules 101 comprises a collection of individual extinguisher modules 111.

Each individual extinguisher module 111 selected from the plurality of extinguisher modules 101 is an electromechanical device. Any first individual extinguisher module 111 selected from the plurality of extinguisher modules 101 is identical to any second individual extinguisher module 111 selected from the plurality of extinguisher modules 101. Each individual extinguisher module 111 selected from the plurality of extinguisher modules 101 releases a fire extinguishing chemical 153 when the selected individual extinguisher module 111 is directly exposed to fire.

Each individual extinguisher module 111 selected from the plurality of extinguisher modules 101 transmits a module alert message containing the GPS location of the selected individual extinguisher module 111 to each individual extinguisher module 111 contained in the plurality of extinguisher modules 101. Each individual extinguisher module 111 selected from the plurality of extinguisher modules 101 transmits an authority alert message containing the GPS location of the selected individual extinguisher module 111 and an image of the sub-region of space protected by the selected individual extinguisher module 111 to the appropriate authority 103.

Each individual extinguisher module 111 selected from the plurality of extinguisher modules 101 transmits the module alert message when the selected individual extinguisher module 111 is directly exposed to fire. Each individual extinguisher module 111 selected from the plurality of extinguisher modules 101 captures an image of the sub-region of space surrounding the selected individual extinguisher module 111 when the individual extinguisher module 111 is directly exposed to fire. Each individual extinguisher module 111 selected from the plurality of extinguisher modules 101 transmits the authority alert message when the selected individual extinguisher module 111 is directly exposed to fire.

Each individual extinguisher module 111 selected from the plurality of extinguisher modules 101 determines the GPS coordinates of the selected individual extinguisher module 111 when the selected individual extinguisher module 111 receives a module alert message. The individual extinguisher module 111 selected from the plurality of extinguisher modules 101 calculates the span of distance between the GPS coordinates of the selected individual extinguisher module 111 and the GPS coordinates contained in the module alert message. If the span of distance calculated by the selected individual extinguisher module 111 is lesser than a previously determined span of distance, the individual extinguisher module 111 initiates the release of a fire retardant chemical 152 into the sub-region of space surrounding the individual extinguisher module 111.

The individual extinguisher module 111 selected from the plurality of extinguisher modules 101 further releases the fire retardant chemical 152 when the selected individual extinguisher module 111 releases the fire extinguishing chemical 153.

In the first potential embodiment of the disclosure, each individual extinguisher module 111 selected from the plurality of extinguisher modules 101 transmits the module alert message as an SMS message over the commercially provided and publicly available cellular wireless network 102. Each individual extinguisher module 111 selected from the plurality of extinguisher modules 101 further transmits the authority alert message as an MMS message over the commercially provided and publicly available cellular wireless network 102.

Each individual extinguisher module 111 comprises an extinguisher apparatus 112 and an extinguisher control circuit 113.

The extinguisher apparatus 112 is a mechanical structure. The extinguisher apparatus 112 forms a fluid network that stores and distributes the fire retardant chemical 152 and the fire extinguishing chemical 153. The extinguisher apparatus 112 mechanically detects the presence of a fire. In response to the mechanical detection of the fire, the extinguisher apparatus 112 discharges the fire extinguishing chemical 153 and the fire retardant chemical 152 into the sub-region of space surrounding the extinguisher apparatus 112. In response to an electrical signal generated by the extinguisher control circuit 113, the extinguisher apparatus 112 discharges the fire retardant chemical 152 into the sub-region of space surrounding the extinguisher apparatus 112 such that the fire extinguishing chemical 153 remains contained within the extinguisher tank 123. The extinguisher apparatus 112 comprises a mounting shell 121, a retardant tank 122, an extinguisher tank 123, and a fluidic network 124.

The mounting shell 121 is a prism-shaped structure. The mounting shell 121 forms a containment structure. The mounting shell 121 anchors to an object within the sub-region of space in which the individual extinguisher module 111 is placed. The mounting shell 121 is a rigid structure. The mounting shell 121 contains the retardant tank 122, the extinguisher tank 123, and the fluidic network 124. The mounting shell 121 is formed with all apertures and form factors necessary to allow the mounting shell 121 to accommodate the use and operation of the invention 100. Methods to form a mounting shell 121 suitable for the purposes described in this disclosure are well-known and documented in the mechanical arts. The mounting shell 121 comprises a containment prism 143, a first mounting structure 141 and a second mounting structure 142.

The first mounting structure 141 is a mechanical structure that attaches to the exterior surface of the mounting shell 121. The first mounting structure 141 forms an anchor point used to attach the mounting shell 121 to an object located in the sub-region of space that contains the individual extinguisher module 111. The second mounting structure 142 is a mechanical structure that attaches to the exterior surface of the mounting shell 121. The second mounting structure 142 forms an anchor point used to attach the mounting shell 121 to an object located in the sub-region of space that contains the individual extinguisher module 111.

The containment prism 143 is a hollow prism-shaped structure. The containment prism 143 is a rigid structure. The containment prism 143 contains the retardant tank 122, the extinguisher tank 123, and the fluidic network 124. The containment prism 143 is formed with all apertures and form factors necessary to allow the containment prism 143 to accommodate the use and operation of the invention 100. Methods to form a containment prism 143 suitable for the purposes described in this disclosure are well-known and documented in the mechanical arts.

The retardant tank 122 is a high pressure tank that contains a compressed gas that forms the fire retardant chemical 152. The retardant tank 122 mounts in the containment space formed by the mounting shell 121. The retardant tank 122 releases the fire retardant chemical 152 into the fluidic network 124 such that the fluidic network 124 discharges the fire retardant chemical 152 into the sub-region of space around the individual extinguisher module 111. The retardant tank 122 further comprises and contains a fire retardant chemical 152. The fire retardant chemical 152 is a chemical. The fire retardant chemical 152 is a compressible fluid known to inhibit combustion reactions.

The extinguisher tank 123 is a high pressure tank that contains a compressed gas that forms the fire extinguishing chemical 153. The extinguisher tank 123 mounts in the containment space formed by the mounting shell 121. The extinguisher tank 123 releases the fire extinguishing chemical 153 into the fluidic network 124 such that the fluidic network 124 discharges the fire extinguishing chemical 153 into the sub-region of space around the individual extinguisher module 111. The extinguisher tank 123 further comprises and contains a fire extinguishing chemical 153. The fire extinguishing chemical 153 is a chemical. The fire extinguishing chemical 153 is a compressible fluid known to stop combustion reactions.

The fluidic network 124 is a mechanical structure that: a) transports the fire retardant chemical 152 from the retardant tank 122 for discharge; b) transports the fire extinguishing chemical 153 from the extinguisher tank 123 for discharge; and, c) controls and routes the flow of fire retardant chemical 152 and fire extinguishing chemical 153 through the fluidic network 124. The fluidic network 124 comprises a solenoid valve 161, an extinguisher valve 162, a check valve 163, and a discharge nozzle 164. The extinguisher valve 162 further comprises a fusible link 165. The fluidic network 124 fluidically interconnects the retardant tank 122 and the extinguisher tank 123. The solenoid valve 161, the extinguisher valve 162, the check valve 163, and the discharge nozzle 164 are fluidically interconnected. The fusible link 165 holds the extinguisher valve 162 in a closed position.

The solenoid valve 161 is a valve that controls the flow of fire retardant chemical 152 from the retardant tank 122 to the discharge nozzle 164. The logic module 131 controls the operation of the solenoid valve 161. The solenoid valve 161 is defined elsewhere in this disclosure.

The extinguisher valve 162 is a valve that controls the flow of fire extinguishing chemical 153 from the extinguisher tank 123 to the discharge nozzle 164. The operation of the extinguisher valve 162 is controlled using a fusible link 165. The fusible link 165 is a flammable metal structure. The fusible link 165 holds the extinguisher valve 162 in a closed position such that the fire extinguishing chemical 153 remains in the extinguisher tank 123 until the destruction of the fusible link 165 by fire releases the extinguisher valve 162 to actuate to an open position that allows: a) the fire extinguishing chemical 153 to flow from the extinguisher tank 123 to the discharge nozzle 164; and, b) the fire retardant chemical 152 to flow from the retardant tank 122 to the discharge nozzle 164.

The check valve 163 is a valve that controls the flow of fire retardant chemical 152 from the retardant tank 122 into the extinguisher valve 162. The check valve 163 limits the flow of the fire retardant chemical 152 in a single direction from the retardant tank 122 towards the extinguisher valve 162. The check valve 163 is defined elsewhere in this disclosure.

The discharge nozzle 164 is a port that releases the fire retardant chemical 152 and the fire extinguishing chemical 153 into the sub-region of space around the individual extinguisher module 111. The design and use of a nozzle suitable for use as a discharge nozzle 164 are well-known and documented in the mechanical arts.

The extinguisher control circuit 113 is an electric circuit. The extinguisher control circuit 113 controls the operation of the individual extinguisher module 111. The extinguisher control circuit 113 tracks the GPS coordinates of the individual extinguisher module 111. The extinguisher control circuit 113 monitors the pressure of the fire extinguishing chemical 153 stored in the extinguisher apparatus 112. The extinguisher control circuit 113 captures an image of the sub-region of space surrounding the extinguisher apparatus 112. The extinguisher control circuit 113 is an independently powered electric circuit. By independently powered is meant that the extinguisher control circuit 113 can operate without an electrical connection to an external power source.

The extinguisher control circuit 113 generates and transmits the module alert message to the plurality of extinguisher modules 101 when the extinguisher control circuit 113 determines that the fire extinguishing chemical 153 has been discharged. The extinguisher control circuit 113 generates and transmits the authority alert message to the appropriate authority 103 when the extinguisher control circuit 113 determines that the fire extinguishing chemical 153 has been discharged.

When an extinguisher control circuit 113 of a first individual extinguisher module 111 selected from the plurality of extinguisher modules 101 receives the module alert message generated by a second individual extinguisher module 111 selected from the plurality of extinguisher modules 101, the first individual extinguisher module 111 calculates the span of the distance between the first individual extinguisher module 111 and the GPS coordinates contained in the module alert message.

The extinguisher control circuit 113 generates and transmits an electrical signal to the solenoid valve 161 of the fluidic network 124 of the extinguisher apparatus 112 when the calculated span of distance is less than the previously determined span of distance. The transmitted electric signal causes the extinguisher apparatus 112 to discharge the fire retardant chemical 152 without discharging the fire extinguishing chemical 153.

The extinguisher control circuit 113 comprises a logic module 131, a communication module 132, a GPS module 133, and a power circuit 137. The communication module 132 further comprises a wireless communication link 138. The logic module 131, the communication module 132, the GPS module 133, and the power circuit 137 are electrically interconnected.

The logic module 131 is a readily and commercially available programmable electronic device that is used to manage, regulate, and operate the extinguisher control circuit 113. Depending on the specific design and the selected components, the logic module 131 can be a separate component within the extinguisher control circuit 113 or the functions of the logic module 131 can be incorporated into another component within the extinguisher control circuit 113.

The communication module 132 is a wireless electronic communication device that allows each individual extinguisher modules 111 selected from the plurality of extinguisher modules 101 to wirelessly communicate SMS messages between the logic module 131 and the balance of the plurality of extinguisher modules 101 through the commercially provided and publicly available cellular wireless network 102. The communication module 132 is a wireless electronic communication device that allows each individual extinguisher modules 111 selected from the plurality of extinguisher modules 101 wirelessly communicate MMS messages between the logic module 131 and the appropriate authority 103 through the wireless communication link 138 with the commercially provided and publicly available cellular wireless network 102.

The use of a commercially provided and publicly available cellular wireless network 102 is preferred because: 1) of its low cost; 2) of the widespread availability and the broad interoperability between competing commercially provided and publicly available cellular wireless networks 102; and, 3) methods and techniques to send SMS and MMS messages over a commercially provided and publicly available cellular wireless network 102 are well known and documented by those skilled in the electrical arts.

The GPS module 133 is an electrical device that communicates with the GPS to determine the GPS coordinates of the GPS module 133. When queried by the logic module 131, the GPS module 133 transfers the GPS coordinates to the logic module 131.

The logic module 131 further comprises a pressure sensor 134, an image sensor 135, and a solenoid controller 136. The pressure sensor 134 electrically connects to the logic module 131. The image sensor 135 electrically connects to the logic module 131. The solenoid controller 136 electrically connects to the logic module 131.

The pressure sensor 134 is an electric device. The logic module 131 monitors the pressure sensor 134. The pressure sensor 134 electrically connects to the logic module 131. The pressure sensor 134 mounts in the fluidic network 124 of the extinguisher apparatus 112 such that the extinguisher apparatus 112 measures the pressure of the fire extinguishing chemical 153 in the extinguisher tank 123.

The image sensor 135 is an electric device. The logic module 131 controls the operation of the image sensor 135. The image sensor 135 mounts on the exterior surface of the mounting shell 121. The image sensor 135 captures an image of the sub-region of space around the individual extinguisher module 111. The image sensor 135 is defined elsewhere in this disclosure.

The solenoid controller 136 is an electric device. The logic module 131 controls the operation of the solenoid controller 136. The solenoid controller 136 generates the electric signal used to operate the solenoid valve 161 of the fluidic network 124.

The power circuit 137 is an electrical circuit. The power circuit 137 powers the operation of the extinguisher control circuit 113. The power circuit 137 is an electrochemical device. The power circuit 137 converts chemical potential energy into the electrical energy required to power the extinguisher control circuit 113. The power circuit 137 comprises a battery 171, a diode 172, and a photovoltaic cell 173. The battery 171, the diode 172, and the photovoltaic cell 173 are electrically interconnected. The battery 171 is further defined with a first positive terminal 181 and a first negative terminal 191. The photovoltaic cell 173 is further defined with a second positive terminal 182 and a second negative terminal 192.

The battery 171 is an electrochemical device. The battery 171 converts chemical potential energy into the electrical energy used to power the extinguisher control circuit 113. The battery 171 is a commercially available rechargeable battery 171. The photovoltaic cell 173 is an electrical device that converts light into electrical energy. The chemical energy stored within the rechargeable battery 171 is further renewed and restored through the use of the photovoltaic cell 173. The photovoltaic cell 173 is directly wired to the battery 171. The photovoltaic cell 173 is an electrical circuit that reverses the polarity of the rechargeable battery 171 and provides the energy necessary to reverse the chemical processes that the rechargeable battery 171 initially used to generate the electrical energy. This reversal of the chemical process creates a chemical potential energy that will later be used by the rechargeable battery 171 to generate electricity.

The diode 172 is an electrical device that allows current to flow in only one direction. The diode 172 installs between the rechargeable battery 171 and the photovoltaic cell 173 such that electricity will not flow from the first positive terminal 181 of the rechargeable battery 171 into the second positive terminal 182 of the photovoltaic cell 173. The photovoltaic cell 173 is defined elsewhere in this disclosure.

The following definitions were used in this disclosure:

Appropriate Authority: As used in this disclosure, an appropriate authority is a previously determined person or organization that is designated to send and receive alarm or other notification messages regarding a monitored system or activity.

Ball Valve: As used in this disclosure, a ball valve is a type of valve. The flow of a fluid through a ball valve is controlled using a spherical structure with a cylindrical channel formed through it. When the center axis of the cylindrical channel is aligned with the center axis of the flow path of the ball valve, fluid will flow through the ball valve. When the center axis of the cylindrical channel is perpendicular to the center axis of the flow path of the ball valve, fluid will not flow through the ball valve.

Battery: As used in this disclosure, a battery is a chemical device consisting of one or more cells, in which chemical energy is converted into electricity and used as a source of power. Batteries are commonly defined with a positive terminal and a negative terminal.

Check Valve: As used in this disclosure, a check valve is a valve that permits the flow of fluid in a single direction. Within selected potential embodiments of this disclosure, the check valve is a commercially available product that is selected from the group consisting of a ball valve and a Tesla valve.

Closed Position: As used in this disclosure, a closed position refers to a movable barrier structure that is in an orientation that prevents passage through a port or an aperture. The closed position is often referred to as an object being "closed." Always use orientation.

Commercially Provided And Publicly Available Cellular Wireless Network: As used in this disclosure, a commercially provided and publicly available cellular wireless network refers to subscription based publically available wireless network commonly used to provide wireless communication access for personal data devices. The commercially provided and publicly available cellular wireless network will typically provide voice communication, data communication services, and SMS and MMS messaging services. The commercially provided and publicly available cellular wireless network is commonly referred to as the cellular network. The commercially provided and publicly available cellular wireless network is abbreviated as the PPWN.

Communication Link: As used in this disclosure, a communication link refers to the structured exchange of data between two objects.

Compressed Gas: In this disclosure, compressed gas refers to a gas that has been compressed to a pressure greater than normal temperature and pressure.

Control Circuit: As used in this disclosure, a control circuit is an electrical circuit that manages and regulates the behavior or operation of a device.

Diode: As used in this disclosure, a diode is a two terminal semiconductor device that allows current flow in only one direction. The two terminals are called the anode and the cathode. Electric current is allowed to pass from the anode to the cathode.

External Power Source: As used in this disclosure, an external power source is a source of the energy that is externally provided to enable the operation of the present disclosure. Examples of external power sources include, but are not limited to, electrical power sources and compressed air sources.

Fluid: As used in this disclosure, a fluid refers to a state of matter wherein the matter is capable of flow and takes the shape of a container it is placed within. The term fluid commonly refers to a liquid or a gas.

Fluid Network: As used in this disclosure, a fluid network refers to a transport structure that: a) receives a fluid into the fluid network; b) transports the fluid through a series of pipes, valves, and manifolds; and, c) discharges the fluid from the fluid network.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

GPS: As used in this disclosure, and depending on the context, GPS refers to: 1) a system of navigational satellites that are used to determine the position, known as GPS coordinates, and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System. Methods to determine the distance and direction between any two sets of GPS coordinates are well-known and documented in the navigational arts.

High Pressure Gas Tank: As used in this disclosure, a high pressure gas tank is a container that is used to store compressed gas.

Image Sensor: As used in this disclosure, an image sensor receives light from the exterior of the image sensor and converts the received light into a digital representation of sufficient detail to allow a logic module to create and display a visual reproduction of the source of the captured light.

Liquid: As used in this disclosure, a liquid refers to a state (phase) of matter that is fluid and that maintains, for a given pressure, a fixed volume that is independent of the volume of the container.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Network: As used in this disclosure, a network refers to a data communication or data exchange structure where data is electronically transferred between nodes, also known as terminals, which are electrically attached to the network. In common usage, the operator of the network is often used as an adjective to describe the network. For example, a telecommunication network would refer to a network run by a telecommunication organization while a banking network will refer to a network operated by an organization involved in banking.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

PPWN: As used in this disclosure, the PPWN is an acronym for publically provided wireless network. The PPWN refers to a commercially provided and publicly available cellular wireless network.

Pressure: As used in this disclosure, pressure refers to a measure of force per unit area.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Shell: As used in this disclosure, a shell is a structure that forms an outer covering intended to contain an object. Shells are often, but not necessarily, rigid or semi-rigid structures that are intended to protect the object contained within it.

SMS: As used in this disclosure, SMS is an abbreviation for short message service. The short message service is a service that is often provided with the cellular services that support personal data devices. Specifically, the SMS allows for the exchange of written messages between personal data devices. The SMS is commonly referred to as text messaging. A common enhancement of SMS is the inclusion of the delivery of multimedia services. This enhanced service is often referred to as Multimedia Media Services which is abbreviated as MMS.

Solenoid: As used in this disclosure, a solenoid is a cylindrical coil of electrical wire that generates a magnetic field that can be used to mechanically move a shaft made of a magnetic core.

Solenoid Valve: As used in this disclosure, a solenoid valve is an electromechanically controlled valve that is used to control fluid or gas flow. A two port solenoid valve opens or closes to fluid flow through the valve portion of the solenoid valve. A three port solenoid valve switched fluid or gas flow between a first port and a second port to either feed or be fed from a third port. A solenoid valve comprises a coil and a valve. The coil forms the solenoid that opens and closes the solenoid valve. The solenoid valve is a valve that opens and closes to control the fluid flow.

Tesla Valve: As used in this disclosure, a Tesla valve is a type of check valve that requires the use of no moving parts.

Valve: As used in this disclosure, a valve is a device that is used to control the flow of a fluid (gas or liquid) through a pipe, tube, or hose.

Wireless: As used in this disclosure, wireless is an adjective that is used to describe a communication channel between two devices that does not require the use of physical cabling.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fire extinguishing apparatus comprising a plurality of extinguisher modules, and an appropriate authority;

wherein a commercially provided and publicly available cellular wireless network is configured to form a wireless communication link between a first individual extinguisher module selected from the plurality of extinguisher modules and each of the individual extinguisher modules remaining in the plurality of extinguisher modules;

wherein the commercially provided and publicly available cellular wireless network further forms a wireless communication link between each individual extinguisher module contained in the plurality of extinguisher modules and the appropriate authority;

wherein the fire extinguishing apparatus is a fire-fighting apparatus;

wherein the plurality of extinguisher modules forms a distributed structure;

wherein by distributed is meant that the plurality of extinguisher modules are positioned over a region of space such that each individual extinguisher module protects a sub-region of space within the region of space from fire;

wherein each of the plurality of extinguisher modules discharges a fire retardant chemical over its sub-region of space;

wherein each of the plurality of extinguisher modules discharges a fire extinguishing chemical over its sub-region of space;

wherein the plurality of extinguisher modules comprises a collection of individual extinguisher modules;

wherein each individual extinguisher module selected from the plurality of extinguisher modules is an electromechanical device;

wherein any first individual extinguisher module selected from the plurality of extinguisher modules is identical to any second individual extinguisher module selected from the plurality of extinguisher modules;

wherein when any selected individual extinguisher module is exposed to a fire, the individual extinguisher module: a) releases a fire extinguishing chemical into the space surrounding the individual extinguisher module; b) transmits a module alert message to each of the individual extinguisher modules remaining in the plurality of extinguisher modules containing the GPS coordinates of the selected individual extinguisher module; c) captures an image of the sub-region of space surrounding the selected individual extinguisher module; and, d) transmits an authority alert message to the appropriate authority containing both the GPS location of the selected individual extinguisher module and the image of the sub-region of space surrounding the selected individual extinguisher module;

wherein when any individual extinguisher module selected from the plurality of extinguisher modules receives a module alert message, the selected individual extinguisher module compares the GPS coordinates of the selected individual extinguisher module to the GPS coordinates of the transmitted module alert message;

wherein if the span of the distance between the two coordinates is less than a previously determined span of distance, then the selected individual extinguisher module releases a fire retardant chemical.

2. The fire extinguishing apparatus according to claim 1 wherein each individual extinguisher module selected from the plurality of extinguisher modules releases a fire extinguishing chemical when the selected individual extinguisher module is directly exposed to fire;

wherein each individual extinguisher module selected from the plurality of extinguisher modules transmits a module alert message containing the GPS location of the selected individual extinguisher module to each individual extinguisher module contained in the plurality of extinguisher modules;

wherein each individual extinguisher module selected from the plurality of extinguisher modules transmits an authority alert message containing the GPS location of the selected individual extinguisher module and an image of the sub-region of space protected by the selected individual extinguisher module to the appropriate authority;

wherein each individual extinguisher module selected from the plurality of extinguisher modules transmits the module alert message when the selected individual extinguisher module is directly exposed to fire;

wherein each individual extinguisher module selected from the plurality of extinguisher modules captures an image of the sub-region of space surrounding the selected individual extinguisher module when the individual extinguisher module is directly exposed to fire;

wherein each individual extinguisher module selected from the plurality of extinguisher modules transmits the authority alert message when the selected individual extinguisher module is directly exposed to fire.

3. The fire extinguishing apparatus according to claim 2 wherein each individual extinguisher module selected from the plurality of extinguisher modules determines the GPS coordinates of the selected individual extinguisher module when the selected individual extinguisher module receives a module alert message;

wherein the individual extinguisher module selected from the plurality of extinguisher modules calculates the span of distance between the GPS coordinates of the selected individual extinguisher module and the GPS coordinates contained in the module alert message;

wherein if the span of distance calculated by the selected individual extinguisher module is lesser than a previously determined span of distance, the individual extinguisher module initiates the release of a fire retardant chemical into the sub-region of space surrounding the individual extinguisher module.

4. The fire extinguishing apparatus according to claim 3 wherein the individual extinguisher module selected from the plurality of extinguisher modules further releases the fire retardant chemical when the selected individual extinguisher module releases the fire extinguishing chemical;

wherein each individual extinguisher module selected from the plurality of extinguisher modules transmits the module alert message as an SMS message over the commercially provided and publicly available cellular wireless network;

wherein each individual extinguisher module selected from the plurality of extinguisher modules further transmits the authority alert message as an MMS message over the commercially provided and publicly available cellular wireless network.

5. The fire extinguishing apparatus according to claim 4 wherein each individual extinguisher module comprises an extinguisher apparatus and an extinguisher control circuit;

wherein the extinguisher apparatus is a mechanical structure;

wherein the extinguisher apparatus forms a fluid network that stores and distributes the fire retardant chemical and the fire extinguishing chemical;

wherein the extinguisher control circuit is an electric circuit;

wherein the extinguisher control circuit controls the operation of the individual extinguisher module.

6. The fire extinguishing apparatus according to claim 5 wherein the extinguisher apparatus mechanically detects the presence of a fire;

wherein in response to the mechanical detection of the fire, the extinguisher apparatus discharges the fire extinguishing chemical and the fire retardant chemical into the sub-region of space surrounding the extinguisher apparatus;

wherein in response to an electrical signal generated by the extinguisher control circuit, the extinguisher apparatus discharges the fire retardant chemical into the sub-region of space surrounding the extinguisher apparatus such that the fire extinguishing chemical remains contained within the extinguisher tank.

7. The fire extinguishing apparatus according to claim 6 wherein the extinguisher control circuit tracks the GPS coordinates of the individual extinguisher module;

wherein the extinguisher control circuit monitors the pressure of the fire extinguishing chemical stored in the extinguisher apparatus;

wherein the extinguisher control circuit captures an image of the sub-region of space surrounding the extinguisher apparatus;

wherein the extinguisher control circuit is an independently powered electric circuit;

wherein by independently powered is meant that the extinguisher control circuit can operate without an electrical connection to an external power source;

wherein the extinguisher control circuit generates and transmits the module alert message to the plurality of extinguisher modules when the extinguisher control circuit determines that the fire extinguishing chemical has been discharged;

wherein the extinguisher control circuit generates and transmits the authority alert message to the appropriate authority when the extinguisher control circuit determines that the fire extinguishing chemical has been discharged;

wherein when an extinguisher control circuit of a first individual extinguisher module selected from the plurality of extinguisher modules receives the module alert message generated by a second individual extinguisher module selected from the plurality of extinguisher modules, the first individual extinguisher module calculates the span of the distance between the first individual extinguisher module and the GPS coordinates contained in the module alert message;

wherein the extinguisher control circuit generates and transmits an electrical signal to the solenoid valve of the fluidic network of the extinguisher apparatus when the calculated span of distance is less than the previously determined span of distance;

wherein the transmitted electric signal causes the extinguisher apparatus to discharge the fire retardant chemical without discharging the fire extinguishing chemical.

8. The fire extinguishing apparatus according to claim 7 wherein the extinguisher apparatus comprises a mounting shell, a retardant tank, an extinguisher tank, and a fluidic network;

wherein the mounting shell contains the retardant tank, the extinguisher tank, and the fluidic network;

wherein the extinguisher control circuit comprises a logic module, a communication module, a GPS module, and a power circuit;

wherein the communication module further comprises a wireless communication link;

wherein the logic module, the communication module, the GPS module, and the power circuit are electrically interconnected.

9. The fire extinguishing apparatus according to claim 8 wherein the mounting shell is a prism-shaped structure;

wherein the mounting shell forms a containment structure;

wherein the mounting shell anchors to an object within the sub-region of space in which the individual extinguisher module is placed;

wherein the mounting shell is a rigid structure.

10. The fire extinguishing apparatus according to claim 9 wherein the retardant tank is a high pressure tank;

wherein the retardant tank further comprises and contains a fire retardant chemical;

wherein the fire retardant chemical is a chemical;

wherein the fire retardant chemical is a compressible fluid known to inhibit combustion reactions;

wherein the retardant tank mounts in the containment space formed by the mounting shell;

wherein the retardant tank releases the fire retardant chemical into the fluidic network such that the fluidic network discharges the fire retardant chemical into the sub-region of space around the individual extinguisher module;

wherein the extinguisher tank is a high pressure tank;

wherein the extinguisher tank mounts in the containment space formed by the mounting shell;

wherein the extinguisher tank further comprises and contains a fire extinguishing chemical;

wherein the fire extinguishing chemical is a chemical;

wherein the fire extinguishing chemical is a compressible fluid known to stop combustion reactions;

wherein the fluidic network is a mechanical structure that: a) transports the fire retardant chemical from the retardant tank for discharge; b) transports the fire extinguishing chemical from the extinguisher tank for discharge; and, c) controls and routes the flow of fire retardant chemical and fire extinguishing chemical through the fluidic network;

wherein the extinguisher tank releases the fire extinguishing chemical into the fluidic network such that the fluidic network discharges the fire extinguishing chemical into the sub-region of space around the individual extinguisher module;

wherein the fluidic network fluidically interconnects the retardant tank and the extinguisher tank.

11. The fire extinguishing apparatus according to claim 10 wherein the fluidic network comprises a solenoid valve, an extinguisher valve, a check valve, and a discharge nozzle;

wherein the solenoid valve, the extinguisher valve, the check valve, and the discharge nozzle are fluidically interconnected;

wherein the solenoid valve is a valve that controls the flow of fire retardant chemical from the retardant tank to the discharge nozzle;

wherein the extinguisher valve is a valve that controls the flow of fire extinguishing chemical from the extinguisher tank to the discharge nozzle;

wherein the check valve is a valve that controls the flow of fire retardant chemical from the retardant tank into the extinguisher valve;

wherein the check valve limits the flow of the fire retardant chemical in a single direction from the retardant tank towards the extinguisher valve;

wherein the discharge nozzle is a port that releases the fire retardant chemical and the fire extinguishing chemical into the sub-region of space around the individual extinguisher module.

12. The fire extinguishing apparatus according to claim 11 wherein the extinguisher valve further comprises a fusible link;

wherein the fusible link holds the extinguisher valve in a closed position;

wherein the operation of the extinguisher valve is controlled using a fusible link;

wherein the fusible link is a flammable metal structure;

wherein the fusible link holds the extinguisher valve in a closed position such that the fire extinguishing chemical remains in the extinguisher tank until the destruction of the fusible link by fire releases the extinguisher valve to actuate to an open position that allows: a) the fire extinguishing chemical to flow from the extinguisher tank to the discharge nozzle; and, b) the fire retardant chemical to flow from the retardant tank to the discharge nozzle.

13. The fire extinguishing apparatus according to claim 12
wherein the logic module is a programmable electronic device;
wherein the logic module controls the operation of the solenoid valve;
wherein the communication module is a wireless electronic communication device that allows each individual extinguisher modules selected from the plurality of extinguisher modules to wirelessly communicate SMS messages between the logic module and the balance of the plurality of extinguisher modules through the commercially provided and publicly available cellular wireless network;
wherein the communication module is a wireless electronic communication device that allows each individual extinguisher modules selected from the plurality of extinguisher modules wirelessly communicate MMS messages between the logic module and the appropriate authority through the wireless communication link with the commercially provided and publicly available cellular wireless network;
wherein the GPS module is an electrical device that communicates with the GPS to determine the GPS coordinates of the GPS module;
wherein when queried by the logic module, the GPS module transfers the GPS coordinates to the logic module.

14. The fire extinguishing apparatus according to claim 13
wherein the logic module further comprises a pressure sensor, an image sensor, and a solenoid controller;
wherein the pressure sensor electrically connects to the logic module;
wherein the image sensor electrically connects to the logic module;
wherein the solenoid controller electrically connects to the logic module;
wherein the pressure sensor is an electric device;
wherein the logic module monitors the pressure sensor;
wherein the pressure sensor electrically connects to the logic module;
wherein the pressure sensor mounts in the fluidic network of the extinguisher apparatus such that the extinguisher apparatus measures the pressure of the fire extinguishing chemical in the extinguisher tank;
wherein the image sensor is an electric device;
wherein the logic module controls the operation of the image sensor;
wherein the image sensor mounts on the exterior surface of the mounting shell;
wherein the image sensor captures an image of the sub-region of space around the individual extinguisher module;
wherein the solenoid controller is an electric device;
wherein the logic module controls the operation of the solenoid controller;
wherein the solenoid controller generates the electric signal used to operate the solenoid valve of the fluidic network.

15. The fire extinguishing apparatus according to claim 14
wherein the power circuit is an electrical circuit;
wherein the power circuit powers the operation of the extinguisher control circuit;
wherein the power circuit is an electrochemical device;
wherein the power circuit comprises a battery, a diode, and a photovoltaic cell;
wherein the battery, the diode, and the photovoltaic cell are electrically interconnected;
wherein the battery is further defined with a first positive terminal and a first negative terminal;
wherein the photovoltaic cell is further defined with a second positive terminal and a second negative terminal;
wherein the battery is an electrochemical device;
wherein the photovoltaic cell is an electrical device that converts light into electrical energy;
wherein the photovoltaic cell is directly wired to the battery;
wherein the photovoltaic cell is an electrical circuit that reverses the polarity of the rechargeable battery;
wherein the diode is an electrical device that allows current to flow in only one direction;
wherein the diode installs between the rechargeable battery and the photovoltaic cell such that electricity will not flow from the first positive terminal of the rechargeable battery into the second positive terminal of the photovoltaic cell.

16. The fire extinguishing apparatus according to claim 15
wherein the mounting shell comprises a containment prism, a first mounting structure, and a second mounting structure;
wherein the first mounting structure is a mechanical structure that attaches to the exterior surface of the mounting shell;
wherein the first mounting structure forms an anchor point used to attach the mounting shell to an object located in the sub-region of space that contains the individual extinguisher module;
wherein the second mounting structure is a mechanical structure that attaches to the exterior surface of the mounting shell;
wherein the second mounting structure forms an anchor point used to attach the mounting shell to an object located in the sub-region of space that contains the individual extinguisher module;
wherein the containment prism is a hollow prism-shaped structure;
wherein the containment prism is a rigid structure;
wherein the containment prism contains the retardant tank, the extinguisher tank, and the fluidic network.

* * * * *